US007803256B2

(12) United States Patent
Delvasigamani

(10) Patent No.: US 7,803,256 B2
(45) Date of Patent: Sep. 28, 2010

(54) CORROSION PROTECTION SYSTEM

(75) Inventor: Sridhar Delvasigamani, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 401 days.

(21) Appl. No.: 11/987,198

(22) Filed: Nov. 28, 2007

(65) Prior Publication Data

US 2009/0138148 A1 May 28, 2009

(51) Int. Cl.
*C23F 13/00* (2006.01)

(52) U.S. Cl. ..... 204/196.01

(58) Field of Classification Search ..... 204/194, 204/196.01–196.03, 196.06, 196.17, 196.18, 204/196.22–196.25, 196.3; 422/6, 7; 440/1, 440/87, 88 C; 363/141, 144
See application file for complete search history.

(56) References Cited

U.S. PATENT DOCUMENTS

| | | | | |
|---|---|---|---|---|
| 5,016,585 | A | 5/1991 | Ito | |
| 7,130,739 | B2 * | 10/2006 | Ito et al. | 701/115 |
| 7,131,877 | B1 * | 11/2006 | Staerzl | 440/76 |
| 2006/0194407 | A1 | 8/2006 | Ching et al. | |
| 2006/0213765 | A1 | 9/2006 | Mizuno et al. | |

FOREIGN PATENT DOCUMENTS

| | | | |
|---|---|---|---|
| JP | 06299377 | A | 10/1994 |
| JP | 07011465 | A | 1/1995 |
| JP | 07305630 | A | 11/1995 |
| JP | 10152787 | A | 6/1998 |
| JP | 11310889 | A | 11/1999 |

OTHER PUBLICATIONS

US Army Corps of Engineers. [online]. Army Technical Manuals [online], Publication No. TM5-811-7, Chapter 1, 2 pages, [retrieved on Nov. 27, 2007]. Retrieved from the Internet: URL: http://www.usace.army.mil/publications/armytm/TM5-811-7/chap1.pdf.

Wikimedia Foundation, Inc. [online]. Cathodic protection [online], 3 pages, [retrieved on Nov. 27, 2007]. Retrieved from the Internet: URL: http://en.wikipedia.org/wiki/Cathodic_protection.

Kingston Technical Software (KTS) Co. [online]. Schematic of an Impressed Current CP System [online], 1 page, [retrieved on Nov. 27, 2007]. Retrieved from the Internet: URL: http://www.corrosion-doctors.org/CP/icpschema.htm.

Roger Alexander, An Idiots Guide to Cathodic Protection [online], 3 pages, [retrieved on Nov. 27, 2007]. Retrieved from the Internet: URL: http://www.airsledge.co.uk/idiots.htm.

James B. Bushman, Impressed Current Cathodic Protection System Design, Bushman & Associates, Inc. [online], 17 pages, [retrieved on Nov. 27, 2007]. Retrieved from the Internet: URL: http://bushman.cc/pdf/impressed_current_system_design.pdf.

* cited by examiner

*Primary Examiner*—Matthew V Nguyen
(74) *Attorney, Agent, or Firm*—Finnegan, Henderson, Farabow, Garrett & Dunner LLC

(57) ABSTRACT

A system for corrosion protection is disclosed. The system includes at least one component subject to corrosion and forming a cathode element. An anode element is disposed proximate the at least one component. A reference element is provided proximate the at least one component and configured to provide a voltage signal. An engine control module is configured to control a marine engine, determine a real-time amount of current for protecting the at least one component from corrosion, and deliver the real-time amount of current to the anode element.

20 Claims, 2 Drawing Sheets

CORROSION PROTECTION SYSTEM

TECHNICAL FIELD

The present disclosure relates generally to a corrosion protection system and, more particularly, to a corrosion protection system for components of a marine engine system.

BACKGROUND

A marine engine system may include a number of components such as, for example, an engine with one or more combustion chambers, a power output unit including a transmission and a propeller, a coolant passage, and a cooling system. Some components of a marine engine system may have direct contact with fluids, such as water. For example, the engine cooling system may use untreated raw water to reduce engine temperature. Some engine system components may be made of metal materials (e.g., steel, aluminum, etc.), which may be sensitive to corrosion by water, such as sea water. Corrosion may cause damage and/or failure of system components, and may result in the lost time and the expense needed to repair or replace the corroded components.

A number of corrosion protection techniques and procedures have been developed. For example, anti-corrosive coating can be applied to the surface of metal components directly exposed to raw water, such as sea water. Although this technique may provide some protection, the protective coating may be damaged and may require regular maintenance, including replacing the damaged coating. Another technique is galvanic cathodic protection, which employs a sacrificial anode made of a metal with higher potential (e.g., zinc or magnesium) than that of the metal (cathode) being protected (e.g., steel or copper). While the galvanic cathodic protection technique may provide effective protection to a marine engine system, it usually requires regular replacement of the sacrificial anode metal due to its gradual consumption. Another technique is impressed current corrosion protection, which uses anode and cathode elements as in the galvanic protection technique, but generates an electric current for delivery to the anode element from an external power source, for example, a battery. In this technique, the anode is not sacrificially consumed.

An impressed current corrosion protection system for a marine engine is disclosed in U.S. Patent Application Publication No. 2006/0213765 A1 to Mizuno et al. ("the '765 publication"). In the system of the '765 publication, a plurality of electrically insulated electrodes are disposed in a coolant passage of an engine filled with conductive coolant. With electrodes connected to an external power supply device, a protective current is generated between the electrodes, transmitted through the conductive coolant, and controlled by a controller for corrosion protection.

While the system of the '765 publication may control corrosion of an engine coolant passage, the system relies on a constant voltage supply or a constant current supply to the electrodes. The constant voltage or current level generated by the controller might be adequate for corrosion protection when initially set up under a certain environment, but may no longer be adequate in a changing environment. As a result, system components may be insufficiently protected against corrosion.

The disclosed corrosion protection system is directed toward improvements and advancements over the foregoing technology.

SUMMARY

In one aspect, the present disclosure is directed to a system for corrosion protection. The corrosion protection system includes at least one component subject to corrosion and forming a cathode element. An anode element is provided proximate the at least one component. A reference element is also provided proximate the at least one component and configured to provide a voltage signal. An engine control module is configured to control a marine engine, determine a real-time amount of current for protecting the at least one component from corrosion, and deliver the real-time amount of current to the anode element.

In another aspect, the present disclosure is directed to a method for protecting components from corrosion including identifying a component subject to corrosion and associating an anode element with the identified component. A voltage signal is generated using a reference element. A real-time amount of current is determined for protecting the identified component from corrosion using an engine control module configured to control a marine engine. The real-time amount of current is delivered to the anode element using the engine control module.

DETAILED DESCRIPTION

Figure 1:
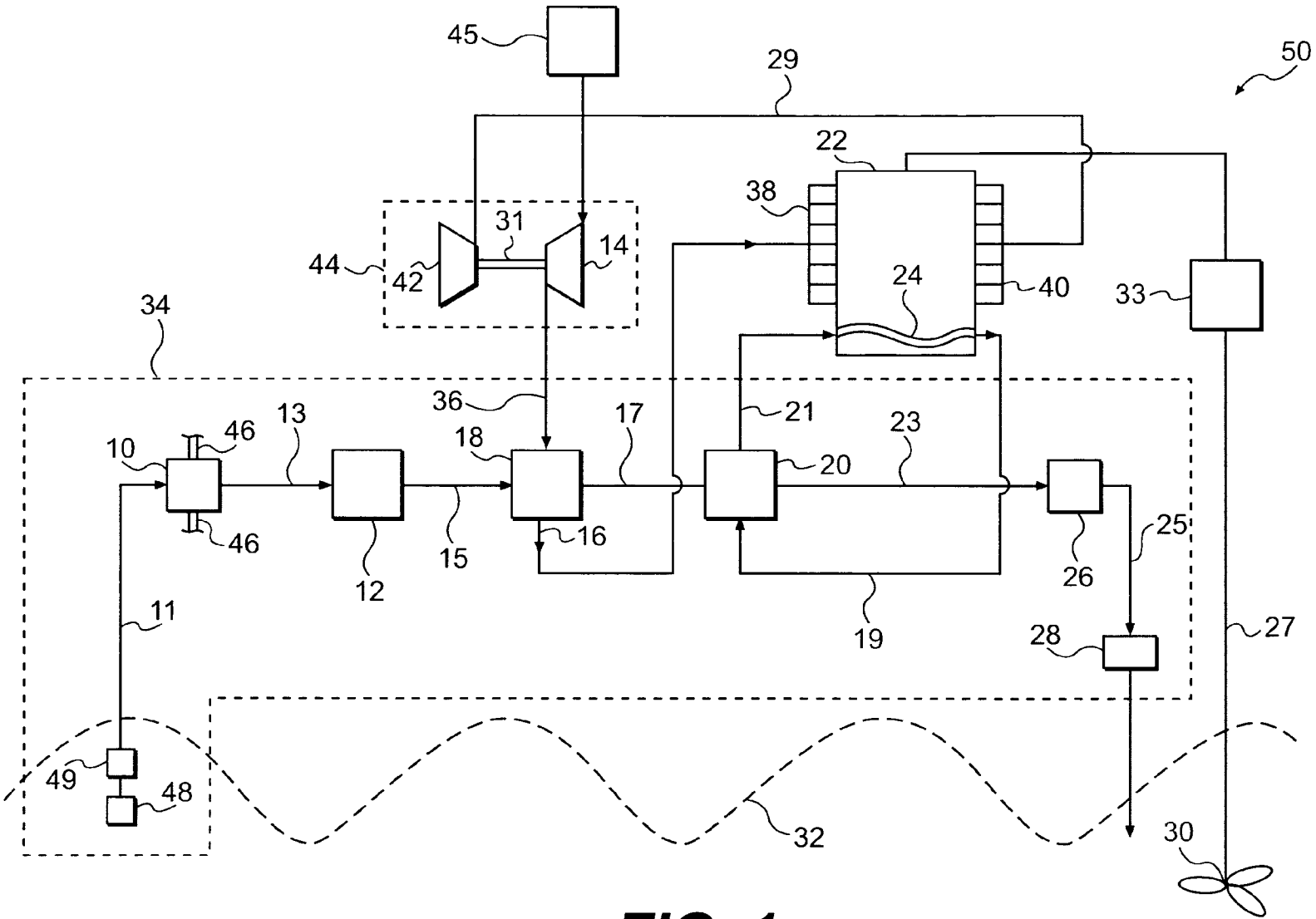
FIG. 1 is a schematic illustration of an exemplary marine engine system.

FIG. 1 diagrammatically illustrates an exemplary marine engine system 50 which may, for example, be associated with a stationary installation in or adjacent a body of water, or associated with a mobile vessel navigating a body of water. Marine engine system 50 may include an engine 22. Engine 22 may include a coolant passage 24 for coolant flow to reduce the temperature of the engine. In some embodiments, engine 22 may include a transmission 33 and a drive shaft 27 connected to a propeller 30 for converting engine power into forces driving a mobile vessel. Engine 22 may also include an air intake manifold 38 and an exhaust manifold 40. The exhaust manifold 40 may be connected to a turbine 42 of a turbocharger 44 through a conduit 29 to supply engine exhaust gases to turbine 42. Turbocharger 44 may further include a compressor 14 drivingly linked with turbine 42 through a shared rotating axle 31, for example.

Marine engine system 50 may also include a cooling system 34 for cooling engine 22 and other associated components. Cooling system 34 may include a fuel cooler 10, a water pump 12, a charge air cooler 18, a heat exchanger 20, a gear oil cooler 26 and an exhaust riser 28, for example. It is also contemplated that the cooling system 34 may not include all above mentioned components, or may include additional components not mentioned above that are also located in the flow path of cooling fluid, and are subject to corrosion. For example, it is contemplated that the cooling system 34 may include a power steering cooler and other heat exchangers. The cooling fluid for cooling system 34 may, for example, be water drawn from a body of water on which a vessel associated with the marine engine system 50 may float.

Fuel cooler 10 for cooling engine fuel may be located downstream of a water inlet 48, which could be a sea cock or a valve. A suitable strainer 49 may be located at or adjacent inlet 48. The connection between the fuel cooler 10 and the water inlet 48 may be established via a conduit 11. Fuel cooler 10 may be connected with fuel line 46, which could be a fuel supply line to or a fuel return line from engine 22, for example. A water pump 12 may be included in the cooling system 34 downstream of the fuel cooler 10 and connected to the fuel cooler 10 by a conduit 13. The water pump 12 may generate a flow of cooling fluid by drawing water from water body 32, for example, a sea or a lake, and may supply the water to the cooling system 34. Water pump 12 may alternatively be located upstream of the fuel cooler 10. In one embodiment, water pump 12 may be located upstream of fuel cooler 10, for example adjacent the water inlet 48.

A charge air cooler 18 may be located downstream of water pump 12 and upstream of a heat exchanger 20, via respective conduits 15 and 17. Charge air cooler 18 may be linked to compressor 14 of turbocharger 44 via a conduit 36. Compressor 14 may draw air from the atmosphere via an air filter 45, compress it, and deliver the compressed air to charge air cooler 18. Subsequently, the compressed and cooled air may be drawn into engine 22 through the engine air intake manifold 38 for combustion. As air from compressor 14 flows through air passages (not shown) of the charge air cooler 18, it may be cooled by charge air cooler 18 before it enters the air intake manifold 38 of engine 22.

A heat exchanger 20 may be located in the cooling system 34 and connected with the engine coolant passage 24 through conduits 19 and 21 to form, in some embodiments, a closed circulating loop for engine coolant. Heat from engine 22 may be delivered to engine coolant which, via heat exchanger 20, may dissipate the heat to the flow of cooling fluid.

The cooling system 34 may further include a gear oil cooler 26. Gear oil cooler 26 may be disposed downstream of heat exchanger 20, for example, and may be connected via a conduit 23 with the heat exchanger 20. Further downstream of the gear oil cooler 26, there may be an exhaust riser 28, where water is expelled out of the cooling system 34 and returned back to the water body 32.

Figure 2:
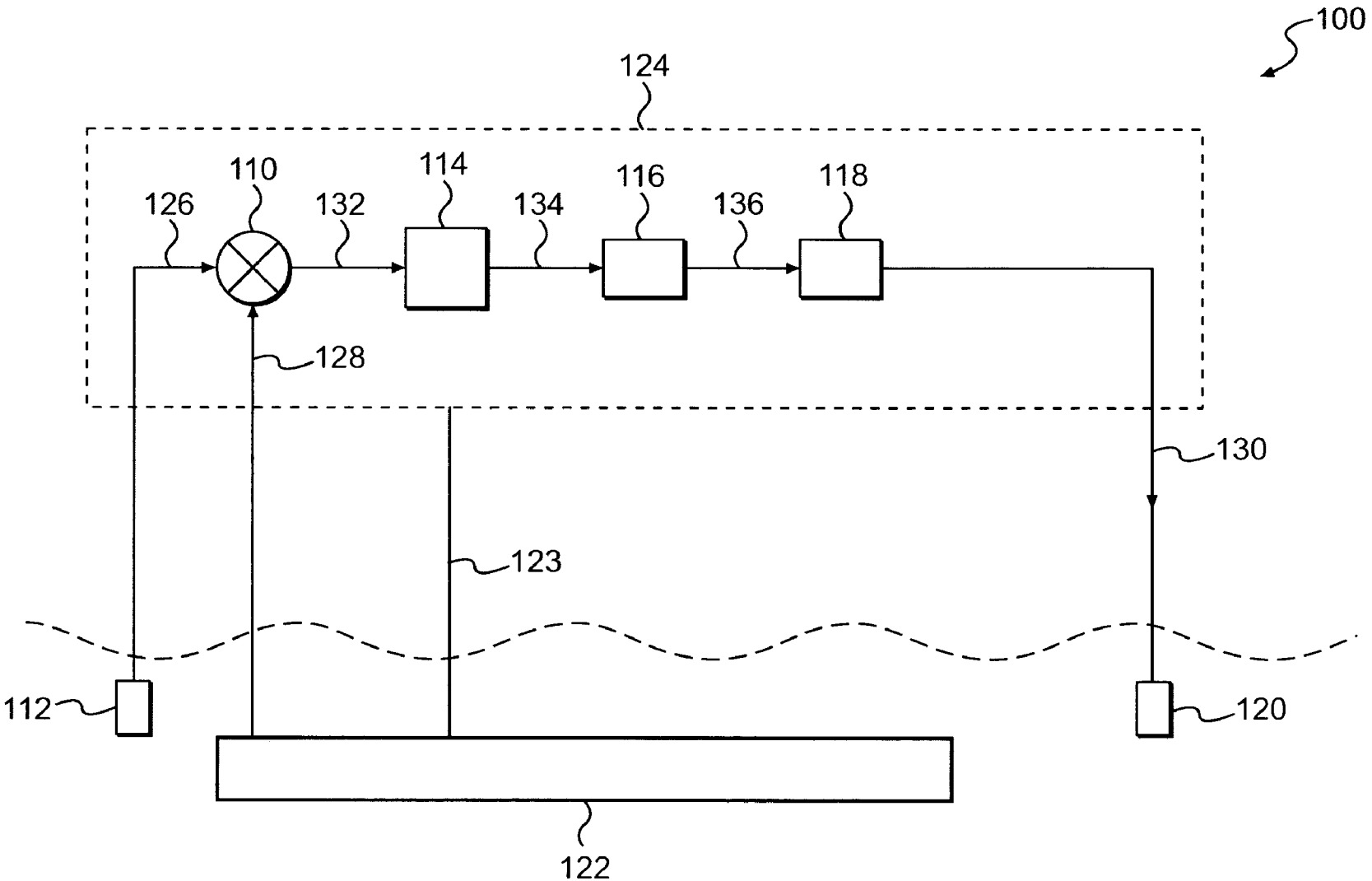
FIG. 2 is a diagrammatic representation of a corrosion protection system according to a disclosed embodiment.

FIG. 2 illustrates an exemplary corrosion protection system 100. Corrosion protection system 100 may include at least one component 122 subject to corrosion and forming a cathode element. In one embodiment, the protected component 122 may be a component of the engine 22, for example, engine coolant passage 24 or propeller 30. In another embodiment, the protected component 122 may be a component of the cooling system 34, for example, engine charge air cooler 18, fuel cooler 10, water pump 12, engine heat exchanger 20, gear oil cooler 26, and/or cooling system exhaust riser 28. The component 122 subject to corrosion could be made of metals, such as steel, copper, or other materials subject to corrosion. A ground line 123 may extend between engine control module 124 and the component 122.

Corrosion protection system 100 may be configured to form a closed loop including a reference element 112 proximate component 122, for example, a few inches from component 122. The actual distance may vary depending on a variety of factors including space limitation for installing the reference element 112, size of the component 122 subject to corrosion, and other application requirements. Reference element 112 could be any appropriate metal depending on the type of metal being protected in component 122. For example, the reference element 112 may be zinc, magnesium, or silver/silver chloride (Ag/AgCl), where the component 122 to be protected includes steel or copper. Reference element 112 may generate a voltage signal 126 to be compared with a voltage signal 128 received from the component 122. The comparison may result in a reference voltage signal 132 indicative of the voltage difference across the reference element 112 and the component 122.

System 100 may also include an anode element 120 proximate component 122, for example, a few inches from component 122. Similar to the reference element 112, the actual distance for the anode element 120 may vary depending on a variety of factors similar to those for the reference element 112. Anode element 120 may be any appropriate metal depending on the type of metal being protected in component 122. For example, element 120 may be zinc, or mixed metal oxides (MMO) coated metal, such as mixed metal oxides coated titanium, or platinized metal such as platinized titanium and niobium.

Both the reference element 112 and the anode element 120 may be at least partially submerged in the same fluid as the fluid which causes corrosion to component 122 and to which component 122 is exposed. In addition, the reference element 112 and the anode element 120 may be electrically isolated, from component 122. For example, in some embodiments, the reference element 112 and the anode element 120 may be installed adjacent a surface of the protected component 122, and a suitable non-conducting material, for example, a nylon plug, may be inserted between the metal surface of the protected component 122 and the reference element 112, and between the metal surface of the protected component 122 and the anode element 120.

Corrosion protection system 100 may also include an engine control module 124 configured to control the engine 22 (FIG. 1). Engine control module 124 in the corrosion protection system 100 may also be configured to determine a real-time amount of current for protecting the component 122 from corrosion, and to deliver the real-time amount of current to the anode element 120.

Engine control module 124 may include a logic circuit 110 configured to receive real-time input voltage signals from the reference element 112 and the component 122 subject to corrosion, and configured to produce an output voltage signal indicative of the difference between the input voltage signals. There may also be an analog-to-digital converter 114 in the engine control module 124, configured to receive an analog signal, for instance, voltage signal 132 produced by the logic circuit 110, and convert the analog signal, into a digital signal 134. In one embodiment, one input port of the logic circuit 110 may be connected through a wire to the reference element 112, another input port may be connected through a wire to the component 122, and the output port of the logic circuit 110 may be connected directly to the analog-to-digital converter 114.

Engine control module 124 may also be provided with an integrator 116 configured to receive an input signal, for instance, signal 134 produced by the analog-to-digital converter 114, perform an integration of the input signal 134, and generate an output signal 136 indicative of the amount of current 130 to be delivered to the anode element 120. The integrator 116 may be configured to perform the integration such that the output signal voltage level reaches at least a preset level and holds at or above that preset level. Integrator 116 may be connected with a digital-to-analog converter 118 configured to receive a digital signal 136 and convert the digital signal 136 into an analog signal (not shown). Digital-to-analog converter 118 may output via its output pin/port (not shown) a certain amount of current determined by the integrator 116 and deliver the current 130 to the anode element 120. In one embodiment, the engine control module 124 may include at least one analog pulse width modulator to deliver the current. In another embodiment, the engine control module 124 may include an analog output device to deliver the current. The engine control module 124 may be programmed to start/stop the corrosion protection system 100 at any appropriate times.

In some embodiments, there may be more than one component 122 subject to corrosion, and protection for more than one component may be achieved using only one anode element 120 and one reference element 112. In other embodiments, protection for multiple components may be achieved using more than one anode element 120 and/or more than one reference element 112.

INDUSTRIAL APPLICABILITY

The disclosed corrosion protection system 100 may be employed on any marine engine system 50 to provide real-time corrosion protection of engine system components. For example, the corrosion protection system 100 may be applied to protect one single component at a time, or multiple components simultaneously. System 100 may also be applied to components of various sizes or surface areas and will adjust the amount of current according to the various sizes or surface areas automatically because of its closed loop configuration. The system 100 may use the existing engine control module 124 commonly provided for controlling a marine engine to perform the control of the current delivered in the corrosion protection system. Thus, the amount of current may be adapted automatically to ensure proper protection in real-time as the environment changes. Such changes may include a change in water salinity and/or a change in water temperature and/or a change in component temperature. Accordingly, the disclosed corrosion protection system 100 may enhance protection of marine engine systems.

As illustrated in FIG. 2, the corrosion protection system 100 may include a reference element 112 and an anode element 120. Both elements may be metal elements, and may be suitably selected according to the metal type of the component 122 subject to corrosion and which is to be protected. For example, the protected metal of component 122 may be steel or copper, and a suitable anode element 120 and reference element 112 may be zinc, magnesium, mixed metal oxides, or some other metal. The anode element 120 and the reference element 112 may be suitably disposed adjacent component 122, and may be sized commensurate with the size of the protected component 122 and space available for installation. Anode element 120 and reference element 112 may be at least partially submerged in the same fluid as the fluid which causes corrosion and to which component 122 is exposed.

The engine control module 124 need not be located any particular distance relative to the protected component 122. Rather it may be located a reasonable distance from the component 122, the anode element 120, and the reference element 112. In other words, the length of wires connecting the component 122, the anode element 120, and the reference element 112 to the engine control module 124 may be customized according to the particular application, as long as the length of the wires does not adversely affect voltage drop.

The reference element 112 and the protected component 122, when submerged in fluid, may generate voltage signals. The voltage signal 126 associated with the reference element 112 may be used to reflect the environmental changes in real-time. These changes include variations in water temperature, water salinity, and oxygen content in the water. Logic circuit 110 may be used to compare the voltage signal 126 and the component voltage signal 128 generated by the component 122, and may produce an analog voltage signal 132 indicative of the difference between these two voltage signals. This analog voltage signal 132 may be converted by the analog-to-digital converter 114 into a digital signal 134, which can be further integrated by the integrator 116. The integrator 116 may produce a signal 136 indicative of the amount of current to be delivered to the anode element 120. Signal 136 may be further converted into an analog signal by the analog-to-digital converter 118. The current may be delivered in analog form by an output port or pin (not shown) of the analog-to-digital converter 118. The current delivered to the anode element 120 may be transmitted by the water from anode 120 to the protected component 122.

FIG. 1 illustrates an exemplary marine engine system 50 in which the exemplary corrosion protection system 100 illustrated in FIG. 2 may be applied. The engine system 50 may be installed in a marine vessel, such as a boat. Engine 22 may combust air and fuel to provide power to a propeller 30 via a drive shaft 27, for example. A cooling system 34, associated with engine system 50, may include a number of components. Water may be drawn by a water pump 12 from the water body 32 into cooling system 34. Water may flow through a fuel cooler 10, a charge air cooler 18, a heat exchanger 20, a gear oil cooler 26, and then be expelled out of the cooling system 34 through an exhaust riser 28.

In one embodiment, the corrosion protection system 100 may be used to protect charge air cooler 18 of the cooling system 34. The anode element 120 and the reference element 112 may be selected according to the metal of the protected charge air cooler 18, and sized according to the size of the charge air cooler 18 and space available for installation. The anode element 120 and the reference element 112 may be installed in proximity to the metal part of the charge air cooler 18, and may use the cooler housing wall or a nearby conduit wall for fixing the anode element 120 and the reference element 112. Wires connecting the component 122, the anode element 120, and the reference element 112 to the engine control module 124 may pass through holes on the cooler housing wall or the nearby conduit wall, and may be customized in length to accommodate the distance between these elements/components and the engine control module 124. Engine control module 124 may be suitably located, for example, at an operator station with other control equipment.

By utilizing the engine control module 124 and a reference element 112 together to monitor the environment changes and control the amount of current to be delivered to the anode element 120, the disclosed corrosion protection system 100 may vary the current supply in real-time in accordance with environmental variations, such as variations in water temperature, water salinity and oxygen content in the water. Instead of using a constant voltage/current supply, which may not be adequate for corrosion protection as environment changes, the disclosed real-time protection system 100 can be adaptive to the environmental changes and can provide an adequate current, thereby enhancing corrosion protection. Because the existing engine control module for a marine engine is programmed to serve as the controller for processing signals and delivering the appropriate amount of current to the anode element, the need for a separate controller for the corrosion protection system is avoided.

It will be apparent to those skilled in the art that various modifications and variations can be made to the corrosion protection system of the present disclosure. Other embodiments of the corrosion protection system will be apparent to those skilled in the art from consideration of the specification and practice of the disclosed embodiments. It is intended that the specification and examples be considered as exemplary only, with a true scope of the disclosure being indicated by the following claims.

What is claimed is:

1. A system for corrosion protection, comprising:

at least one component subject to corrosion and forming a cathode element;

an anode element proximate the at least one component;

a reference element proximate the at least one component and configured to provide a voltage signal; and an engine control module configured to:

control a marine engine;

determine a real-time amount of current for protecting the at least one component from corrosion; and deliver the real-time amount of current to the anode element.

2. The system of claim 1, wherein the engine control module includes an integrator configured to receive an input signal, perform an integration of the input signal, and generate an output signal indicative of the amount of current to be delivered to the anode element.

3. The system of claim 2, wherein the engine control module further includes:

an analog-to-digital converter configured to receive an analog signal and convert the analog signal into a digital signal; and a digital-to-analog converter configured to receive a digital signal and convert the digital signal into an analog signal.

4. The system of claim 3, wherein the engine control module further includes a logic circuit configured to receive real-time input voltage signals from the reference element and the at least one component subject to corrosion, and configured to produce an output voltage signal indicative of the difference between the input voltage signals.

5. The system of claim 4, wherein the engine control module configured to deliver current to the anode element includes at least one analog pulse width modulator for delivering the current.

6. The system of claim 1, wherein the at least one component subject to corrosion is a component of the marine engine.

7. The system of claim 6, wherein the component of the marine engine is at least one of an engine coolant passage and a propeller.

8. The system of claim 1, wherein the at least one component subject to corrosion is a marine engine cooling system component.

9. The system of claim 8, wherein the cooling system component is at least one of an engine charge air cooler, a fuel cooler, a water pump, an engine heat exchanger, a gear oil cooler, and a cooling system exhaust riser.

10. A method for protecting components from corrosion, comprising:

identifying a component subject to corrosion;

associating an anode element with the identified component;

generating a voltage signal using a reference element;

determining a real-time amount of current for protecting the identified component from corrosion using an engine control module configured to control a marine engine; and delivering the real-time amount of current to the anode element using the engine control module.

11. The method of claim 10, further including:

receiving an input signal in an integrator;

integrating the input signal; and generating an output signal indicative of the amount of current to be delivered to the anode element.

12. The method of claim 10, further including:

receiving real-time input voltage signals from the reference element in a logic circuit;

receiving real-time input voltage signals from the at least one component subject to corrosion in the logic circuit; and generating an output voltage signal indicative of the difference between the input voltage signals from the reference element and the input voltage signals from the at least one component.

13. The method of claim 10, further including:

receiving an analog signal and converting the analog signal into a digital signal; and receiving a digital signal and converting the digital signal into an analog signal.

14. The method of claim 10, wherein identifying a component includes identifying at least one of an engine component and a cooling system component.

15. The method of claim 14, wherein identifying at least one of an engine component and a cooling system component includes identifying at least one of an engine coolant passage, a propeller, a fuel cooler, a water pump, an engine charge air cooler, an engine heat exchanger, a gear oil cooler, and a cooling system exhaust riser.

16. A marine engine system, comprising:

a marine combustion engine;

a cooling system associated with the combustion engine and configured to dissipate heat; and a system for protecting at least one engine and/or cooling system component from corrosion, including:

at least one component subject to corrosion and forming a cathode element;

an anode element proximate the at least one component;

a reference element proximate the at least one component and configured to provide a voltage signal; and an engine control module configured to:

control the marine combustion engine;

determine a real-time amount of current for protecting the at least one component from corrosion; and deliver the real-time amount of current to the anode element.

17. The marine engine system of claim 16, wherein the at least one component subject to corrosion is a component of the engine and/or the engine cooling system, including an engine coolant passage, a propeller, an engine charge air cooler, a fuel cooler, a water pump, an engine heat exchanger, a gear oil cooler, and a cooling system exhaust riser.

18. The marine engine system of claim 16, wherein the engine control module includes:

an integrator configured to receive an input signal, perform an integration of the input signal, and generate an output signal indicative of the amount of current to be delivered to the anode element;

an analog-to-digital converter configured to receive an analog signal and convert the analog signal into a digital signal; and a digital-to-analog converter configured to receive a digital signal and convert the digital signal into an analog signal.

19. The marine engine system of claim 16, wherein the engine control module includes at least one analog pulse width modulator for delivering the current.

20. The marine engine system of claim 16, wherein the engine control module further includes a logic circuit configured to receive real-time input voltage signals from the reference element and the at least one component subject to corrosion, and configured to produce an output voltage signal indicative of the difference between the input voltage signals.

* * * * *